United States Patent [19]

Tabereaux et al.

[11] Patent Number: 4,654,130

[45] Date of Patent: Mar. 31, 1987

[54] METHOD FOR IMPROVED ALUMINA CONTROL IN ALUMINUM ELECTROLYTIC CELLS EMPLOYING POINT FEEDERS

[75] Inventors: Alton T. Tabereaux, Sheffield; William E. Watts; Claude A. Wilson, both of Florence, all of Ala.

[73] Assignee: Reynolds Metals Company, Richmond, Va.

[21] Appl. No.: 863,353

[22] Filed: May 15, 1986

[51] Int. Cl.[4] ..... C25C 3/06

[52] U.S. Cl. ..... 204/67

[58] Field of Search ..... 204/67

[56] References Cited

U.S. PATENT DOCUMENTS

| | | | |
|---|---|---|---|
| 3,400,062 | 9/1968 | Bruno et al. | 204/67 |
| 3,455,795 | 7/1969 | Boulanger et al. | 204/67 |
| 3,573,179 | 3/1971 | Dirth et al. | 204/67 |
| 3,583,896 | 6/1971 | Piller | 204/67 |
| 3,622,475 | 11/1971 | Shiver | 204/67 |
| 3,625,842 | 12/1971 | Bristol et al. | 204/67 |
| 3,629,079 | 12/1971 | Bristol | 204/67 |
| 3,712,857 | 1/1973 | Piller | 204/67 |
| 3,847,761 | 11/1974 | Haupin | 204/67 |
| 3,888,747 | 6/1975 | Murphy | 204/67 |
| 4,035,251 | 7/1977 | Shiver et al. | 204/67 |
| 4,126,525 | 11/1978 | Wakaizumi et al. | 204/67 |
| 4,425,201 | 1/1984 | Wilson et al. | 204/67 |
| 4,431,491 | 2/1984 | Bonny et al. | 204/67 |
| 4,437,950 | 3/1984 | Arita et al. | 204/67 |
| 4,447,301 | 5/1984 | Shen | 204/67 |

*Primary Examiner*—Howard S. Williams

*Attorney, Agent, or Firm*—Alan T. McDonald

[57] ABSTRACT

The present invention describes a method for controlling alumina additions to reduction cells employing point feeders referred to as automatic feed. Automatic feed reduces the possibility of operating the cell at either too low or too high levels of alumina in the bath, and eliminates all anode effects except those desired, thus resulting in increased metal production.

10 Claims, 2 Drawing Figures

METHOD FOR IMPROVED ALUMINA CONTROL IN ALUMINUM ELECTROLYTIC CELLS EMPLOYING POINT FEEDERS

FIELD OF THE INVENTION

The present invention relates to a technique for controlling the amount of alumina fed to a reduction cell operating with point feeders so as to avoid anode effects due to cell underfeeding and the build up of "muck" due to overfeeding.

BACKGROUND OF THE INVENTION

In the conventional operation of electrolytic reduction cells which reduce alumina, $Al_2O_3$, to aluminum, Al, the alumina is added to the cell according to a prescribed fixed time schedule.

The basic inherent disadvantage to this conventional method of controlling alumina additions to reduction cells, that is, breaking a specified area of a crusted layer of alumina into the molten cryolitic bath based on a fixed time interval cycle, is that there is no means of sensing the amount of alumina in the bath and taking corrective action.

Thus, if an excessive quantity of alumina is added over a length of time, there will be an accumulation of material, "muck", on the sides and bottom of the cathode that will eventually result in operational difficulties that decrease metal production. On the other hand, if too little alumina is consistently added to the cell, extra energy is required to operate the cell due to the increased anode overpotential, and the "anode effect" frequency which results from such underfeeding increases, lowering the metal production in all of the cells in the potline.

U.S. Pat. No. 3,583,896 to Piller, issued June 8, 1971, the disclosure of which is hereby incorporated herein by reference, describes a method for detecting "electrode upsets" in an aluminum reduction cell wherein the cell's so-called zero current interce $E_k$ is monitored. According to this method, a cell's voltage is measured at various times and current levels to determine the cell's operating characteristics. Projected zero-current intercept values, $E_k$, are then determined for those operating conditions. That is, for each condition, an extrapolation is made to determine what the cell's theoretical voltage would be if the current were zero. From this data a determination is made of the cell's "normal" $E_k$ value. If the $E_k$ value falls below a predetermined level corresponding to that set for the particular type of cell, it is taken as an indication that the cell is entering an electrode upset whereby operating procedures may be taken to control the cell so that the electrode upset can be reduced or eliminated.

Although the technique described by Piller provides a method for determining when an electrode upset may occur, thereby permitting corrective action which may comprise feeding of the cell or causing an intentional "anode effect," the method merely provides a means for detecting the critical conditions once they occur and not for preventing them in advance.

In U.S. Pat. No. 4,425,201 to Wilson et al, issued Jan. 10, 1984, the disclosure of which is hereby incorporated herein by reference, a method for controlling alumina additions to a reduction cell, based upon a statistical analysis of the resistance values within the cell, is disclosed. This system was devised with regard to center breaker bar containing cells. Such cells receive alumina along the entire length of the breaker bar.

More recently, these breaker bars have been replaced by point feeders positioned at strategic locations above the cell. In these cells, small measured amounts of alumina are fed to the cell from any or all of the point feeders at a given time.

The nature of point feeder cells, as opposed to breaker bar cells, is such that much finer control of alumina additions is necessary. This is due to the smaller amount of alumina at each addition, as well as the multiple alumina addition points.

Thus, it would be highly desirable in the art if a system of automatic feed were available for point feeder type cells whereby through some monitoring of the cell, information regarding the need, or lack of same, for feeding the cell could be provided and the feed rate of the cell modified based upon this information.

SUMMARY OF THE INVENTION

The present invention describes a method for controlling alumina additions from point feeders to reduction cells referred to as automatic feed. Automatic feed reduces the possibility of operating the cell at either too low or too high levels of alumina in the bath, and eliminates all anode effects, except those desired, thus resulting in increased metal production.

The automatic feed cell operation of the present invention proceeds in the following manner:

1. The rate of change in the bath resistance of the cell with respect to time (slope) g is determined. As the alumina content in the bath decreases due to metal production, bath resistance increases due to increased anode overpotential.

2. A statistical correlation coefficient R of the last N number of readings of the cell's bath resistance is made.

3. If the following conditions exist:

(a) the slope g is within a predetermined range of G volts/minute at the normalized line amperage, and if, (b) the square of the correlation coefficient, $R^2$, exceeds a predetermined limit H, and if, (c) the sum of the slopes, S, exceeds an assigned limit value, L, then an anode effect is predicted as evident by a substantial increase in anode over-voltage; i.e., indicating low alumina content in bath.

4. Alumina is then added to the cell at a significantly higher than required rate to increase the alumina content from the low value to a level up to or exceeding the normal alumina content for the cell in the following manner:

(a) Ultrarapid feed rate for a period of time (normally 5–30 minutes) at a rate of feed substantially higher than the regular feed rate. The time and rate are preset with change possible through manual entry.

(b) Rapid feed rate for a period of time (normally 10–60 minutes) at a rate of feed somewhat higher than the regular feed rate. The time and rate are preset with change possible through manual entry.

(c) Regular feed rate for a period of time (normally 30 minutes–3 hours) with changes made by manual entry.

(d) Suspended feed status (point feeders off until an anode effect prediction is made or forced anode effect).

5. The regular feed rate is adjusted to maintain a specified time interval between each cycle based on the average time between cycles over the past 24 hour period.

BRIEF DESCRIPTION OF THE DRAWINGS

The automatic feed process of the present invention will be more fully described with reference to the drawings in which.

DETAILED DESCRIPTION OF THE INVENTION

Figure 1:
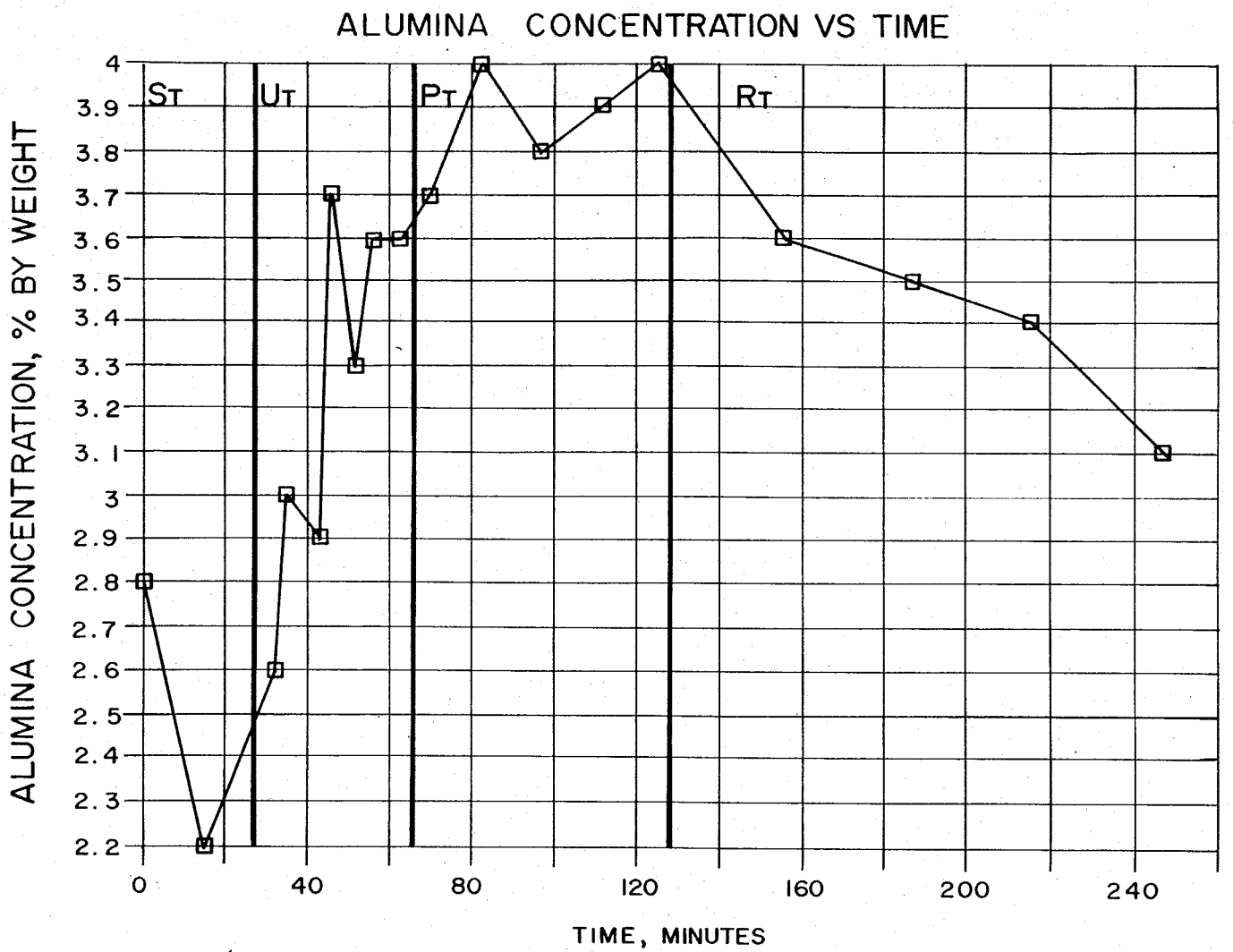
FIG. 1 is a graph of alumina concentration versus time for a typical control cycle according to the present invention.

With automatic feed, the feed rate of the point feeders depends upon the alumina content in the bath. If extra alumina is added due to an abnormal operating condition or due to other processes such as changing anodes, the rate of alumina feed from the point feeders changes until the alumina content in the bath has decreased to a low enough alumina level to cause an increase in the bath resistance, measured as a positive slope g by the monitoring computer.

Thus, the cell is prevented from obtaining an excessive accumulation of alumina in the bath due to such events as changing anodes, changes in alumina properties (density), etc., as the rate of alumina feed will automatically decrease until the higher alumina level decreases to normal levels.

In the event of underfeeding, i.e., too little alumina in the bath, the rate of alumina feed will increase to maintain a minimum alumina level.

The rate of change in bath resistance g for a given cell configuration is obtained by measuring such resistance using conventional amperometric techniques on a typical cell of the specified configuration when the cell is intentionally driven to an overfed or underfed condition under controlled conditions. Thus, for a given cell type the bath resistance is monitored over time as controlled over and underfeeding of the cell is performed. These measurements will define a line when resistance versus time is graphed. The slope of this line will, of course, define the rate of change in the resistance of the cell with respect to time.

The bath resistance described above is normally monitored by monitoring the line resistance of the test cell and ultimately the line resistance of any controlled cell. Such measurements are, of course, subject to certain inherent inaccuracies due to a number of factors which include: (1) the accuracy of the measuring equipment and external influences on the cell such as anode movement, current changes which are not detectable, since most monitoring is based on an assumed constant EMF which may not (and generally is not) actual; (2) manual manipulation of the cell in some manner which is not reportable by the control system; (3) distortion of the metal pad due to current changes, etc. Thus, to compensate for such events, a statistical technique must be applied to test the accuracy of the resistance data being obtained. For simplicity, the resistance of a cell is expressed as a normalized voltage:

$$VN = \frac{(VR - BEMF)}{(AR)} AB + BEMF$$

where:

VN=cell voltage normalized to the base amps.

VR=voltage read.

AR=line amps as measured.

AB=base amps. This is normally close to the average line amps.

BEMF=average back electronic force (back EMF) of the cell.

An inspection of this equation reveals that the voltage across a cell is composed of two general types. The first (VR) is ohmic in nature while the second (BEMF) is back EMF and therefore honohmic. There would not be any problems with determining cell resistance (normalized voltage) if the line current were constant. However, this is never the case in an operating environment. Therefore, the major error in determining resistance arises in the following manner:

1. The back EMF is not constant, but varies according to the chemical composition of the electrolytes. An error as small as 100 mv between the average back EMF and the actual back EMF of a cell with a line current change of 10 kilo amps will result in an error in the cell resistance calculation of an order of magnitude larger than the change in resistance used to infer alumina concentration for control purposes.

2. With a change in line current, there is an associated change in magnetic field. If the change in magnetic field lasts long enough, the paramagnetic molten aluminum in the bottom of the cathode will take a new physical shape. This results in an effective change in anode to cathode distance, with its corresponding change in cell resistance. This type of error in resistance reading is on the same order of magnitude as the change in resistance used for control purposes.

3. Operator intervention to perform various tasks such as tapping, anode changing, etc. may cause errors of orders of magnitude larger than the resistance change used to infer alumina concentration.

4. Computer control actions also result in resistance error, but are relatively easy to deal with since the exact nature of these actions is known.

With the knowledge that the above mentioned errors exist, the herein disclosed control technique was designed. The system makes multiple readings of the cell resistance over time, discarding those readings where the line current is not sufficiently close to the base line current to find a single point in the resistance versus alumina curve. A number of these points are then used to calculate the present rate of change in cell resistance and the correlation coefficient between the points. This technique minimizes the essentially random errors associated with changes in line current since the readings are selectively chosen and since the error will diminish with the square root of the number of readings. During the time that rate of change of resistance is small, the data points will have a random error which results in a low correlation coefficient. As the rate of change in slope increases, it becomes larger than the random errors, resulting in a higher correlation coefficient which is employed for control purposes. Errors caused by operator intervention are detected because the control system reads the status of the automatic/manual switch located on the cell control panel. This switch must be placed in the manual setting before actions can be taken. In the case of operator intervention, the control system requires that a higher than normal correlation coefficient be obtained before changing the feed rate of the point feeders. This method is effective because most operating events of significance result in step changes in resistance which disturbs the correlation coefficient.

If the control system has found it necessary to adjust the anode bridge, an error in the resistance calculation results. This is negated by the assumption that there would not have been a change in resistance if the control system had not caused it. Therefore, subsequent resistance readings are corrected for this event.

No anode effects will occur in cells operated on automatic feed as the cell's bath resistance indicates a need for feed rate change from 15 to 45 minutes prior to the onset of the anode effect.

Thus, automatic feed provides a method to sense, or estimate, alumina levels in the bath and to take corrective action by automatically making adjustments in the alumina feed rates of the point feeders to adjust for too low or too high alumina levels and prevent anode effects.

With point feeders, it was previously not possible to determine whether the cell was being underfed or overfed. When employing the procedures of automatic feed, the feed rate is adjusted and compensates for the actual rate at which alumina is consumed by the cell.

With this outline of the procedures used for automatic feed of a reduction cell in mind, the methods used to select the variables noted hereinabove and to adjust for the aforementioned "events" which may affect resistance readings will now be described.

According to the method of the present invention for a given cell structure or configuration, the following steps are performed:

(a) The rate of change in bath resistance of the cell with respect to time is determined to define a line slope g.

(b) A statistical correlation coefficient, R, of the last N number of readings of the cell's bath resistance is made; and, if all of the following conditions exist, an altered feed rate schedule is implemented:

(i) The slope g is within a predetermined range of G volts/minute at a normalized line amperage;

(ii) The square of the correlation coefficient, $R^2$, exceeds a predetermined limit, H, and (iii) The sum of the slopes, S, exceeds an assigned limit value, L.

As previously mentioned, the final criteria for determining whether a change in feed rate is necessary is the sum S of the slopes g. When S exceeds a predetermined limit L, this condition has been satisfied.

In order to achieve a complete understanding of the process of the present invention, it is, of course, necessary to understand the methods used to determine and/or specify each of the control variables G, L and H.

Thus, selection of values for G and H in the present process is made in the following manner:

A large number of anode effects are permitted to occur in a cell of a configuration typical of that in those to be controlled while tracking the pot resistance versus time, preferably with a computer control system;

A point is then empirically chosen on the resistance versus time graph at which there exists a high degree of confidence (i.e. greater than 80%) that the increasing resistance is due to the decreasing alumina concentration and not due to other causes.

The minimum limits for the slope G and correlation coefficient H are chosen to be those that are present at the above defined and preselected point.

The resistance versus time graph is also studied to determine the effect of events such as an anode bridge adjustment, tapping, etc. These events generate slopes much higher than those associated with an increase in resistance due to decreasing alumina. In this manner, a maximum limit for the slope G is also chosen to exclude the above mentioned events from consideration.

L is selected emperically by creating a large number of anode effects, in the same manner as described above. L is selected to give at least a 90% probability that an anode effect is about to occur.

S is reset to zero after an anode effect or the start of ultrarapid feed.

The statistical technique applied to verify the accuracy of the measured resistance values in this instance is that commonly referred to as the least square line. This technique is well known and the details of its application can be found in any standard text on statistics, for example Numerical Mathematical Analysis, James B. Scarborough, Johns Hopkins Press, Baltimore, Maryland, Sixth Ed. 1966, PG 533ff.

In abbreviated form, the least square line approximating the set of points $(X_1,Y_1)$, $(X_2,Y_2)$, --- $(X_n,Y_n)$ (for example in the resistance versus time graph of the present invention) for the equation:

$$Y=Ao+A_1X$$

where the constants Ao and $A_1$ are determined by solving simultaneously the equations:

$$\Sigma Y=AoN+A_1\Sigma X$$

$$\Sigma XY=Ao\Sigma X+A_1\Sigma X^2$$

The constants Ao and $A_1$ can be found by:

$$Ao = \frac{(\Sigma Y)(\Sigma X^2) - (\Sigma X)(\Sigma XY)}{N\Sigma X^2 - (\Sigma X)^2}$$

$$A_1 = \frac{N\Sigma XY - (\Sigma X)(\Sigma Y)}{N\Sigma X^2 - (\Sigma X)^2}$$

$$R = \frac{N\Sigma XY - (\Sigma X)(\Sigma Y)}{([N\Sigma X^2 - (\Sigma X)^2][N\Sigma Y^2 - (\Sigma Y)^2])^{\frac{1}{2}}}$$

Where:

Ao is the value of Y at X=0 and $A_1$ is the slope of the line.

$R^2$ is the square of the correlation coefficient and is zero if there is no correlation between the resistances, and is 1 if there is perfect correlation.

The regular feed rate modulation is based on the value of the average time $K_T$ for a cycle relative to a set of changeable upper and lower control bands (2 on each side) with different degrees of adjustment depending on whether the average cycle time is within the inner bands, between the inner and outer bands, or outside the outer control bands.

A. If the average time interval $K_T$ between the last previous M (normally 6) number of cycles was less than the desired time, then 1. If the average time interval $K_T$ is inside the inner lower control band, no action is required.

2. If the average time interval $K_T$ is between the inner and outer bands, then increase the regular feed rate by a predetermined percentage.

3. If the average time interval $K_T$ is below the outer control band, increase the regular feed rate by a larger percentage.

B. If the average time interval $K_T$ for the last previous M number of cycles was greater than the desired set value, then 1. If the average time interval $K_T$ is within the inner upper control band, no action is taken.

2. If the average time interval $K_T$ is between the inner and the outer control bands, then decrease the regular feed rate by a specified percentage.

3. If the average time interval $K_T$ is greater than the outer upper control band, then decrease the regular feed rate by a larger percentage.

The times given above will provide a 4 hour cycle based on an estimate that the time needed to predict an anode effect will be one hour.

I. SHORT TERM ALUMINA CONTROL REGULATION

FIG. 1 shows a section of a series of observed alumina control cycles from a reduction cell operating with all of the alumina being fed to the cell through multiple alumina point feeder devices. The feeders deliver a specified amount of alumina, by volume, to the cell's cryolitic bath at regulated intervals to maintain the cell's normal production rate of aluminum metal. At each control point of the automatic feed alumina control algorithm the onset of an anode effect/or low alumina is predicted by calculations based on the measurement of the rate of increase of the cell's resistance as the alumina concentration approaches the level at which an anode effect will occur (normally less than 2.0 weight percent alumina). A preprogrammed set of changes in the cell's alumina feed rate through the point feeders is activated at each feeder, which regulates the rate at which alumina is delivered to the cell during strategic periods of time as shown in FIG. 1 for a reduction cell.

Alumina Control Periods

A. Ultrarapid feed rate, $U_T$, for a specific period of time (normally 5–30 minutes) at a rate substantially higher (normally 25–60% higher) than the regular feed rate.

B. Rapid feed rate, $P_T$, for a specified period of time (normally 10–60 minutes) at a rate somewhat higher (normally 10–40% higher) than the regular feed rate.

C. Regular feed rate, $R_T$, for a specified period of time (normally 30 minutes–3 hours) based on a predetermined (theoretical) replacement of alumina feed, to maintain the reduction process.

D. Suspended feed, $S_T$, until an anode effect is predicted, or forced, if desired.

Decision Making

Changes are made to the point feeders' feed rate depending on the values of the slope g, the square of the correlation coefficient $R^2$, and the sum of the slopes S:

A. If the slope value g exceeds an assigned limit value G, and

B. the square of the correlation coefficient $R^2$ exceeds an assigned limit value H, and C. the sum of the slopes S exceed an assigned limit value L then, An anode effect is predicted as evident by a substantial increase in the anode overpotential, indicating low alumina concentration (normally less than 2.0%) and alumina is added to the reduction cell at significantly higher than required rate to increase the alumina content from the low value to a level up to or exceeding the normal alumina content for the cell (normally about 3.0 to 4.0%) in the following manner:

A. Ultrarapid feed rate, substantially higher (normally about 25–60% higher) than the regular feed rate.

B. Rapid feed rate, somewhat higher (normally about 10–40% higher) than the regular feed rate.

The minimum alumina concentration in the bath of the cell, prior to the anode effect prediction depends on the value selected for the slope requirement G. The higher the value chosen for G then the lower will be the alumina content in the bath at the time of the prediction and the more reliable the prediction. High G will neither minimize the cell's bath resistance nor maximize the ampere efficiency. If G values are chosen too low, it becomes more difficult to accurately predict a positive increase in the resistance slope due to low alumina compared to other events.

II. LONG TERM ALUMINA CONTROL BY FEED MODULATION

The regular feed rate $R_T$ of each alumina control cycle is varied based on a simple control algorithm that allows the process control computer to modulate the regular feed rate based on the average time interval of the last M (normally six) alumina control cycles (which normally requires about 24 hours), compared with a predetermined cycle target time period, $O_T$ (normally about 4 hours). Accordingly, the ultrarapid feed rate $U_T$ and rapid feed rate $P_T$ are based on the regular feed rate; consequently they are also modulated when the regular feed rate is changed. Thus, alumina is added to the reduction cell at a faster or slower rate corresponding to the average time interval between alumina control cycles compared with a predetermined cycle target time, $O_T$.

An average cycle time $K_T$, illustrated by the complete cycle shown in FIG. 1, equal to the predetermined target cycle time $O_T$ between control cycles is indicative of a correct alumina level in the cell's bath, and requires no corrective action to the cell's feed rate.

A longer average cycle time $K_T$ than the predetermined target cycle time $O_T$ between control cycles is indicative of a general higher than desired alumina level in the cell's bath and requires a corrective reduction in the cell's alumina feed rate.

A shorter average cycle time $K_T$ than the predetermined target cycle time $O_T$ between control cycles is indicative of a lower than desired alumina level in the cell's bath and requires a corrective increase in the cell's alumina feed rate.

The alumina feed modulation algorithm infers the alumina concentration in the cell from the changes in the cell's average alumina control cycle from a predetermined target cycle time, $O_T$.

The only time period that is not fixed in the alumina control cycle is the anode effect prediction period $S_T$; when the alumina feed to the cell is suspended. The time it takes the cell to go from the point when alumina feed is suspended to when an anode effect is predicted/or occurred is utilized to infer the alumina concentration in the cell's bath.

A long anode effect prediction time period $S_T$ is indicative of a high alumina level (normally gteater than 4%), in the cell and is an undesirable situation as it will eventually result in excessive alumina muck build up on the cathode floor under each point feeder device, due to solubility limitations, which can affect the cell's performance and increases the cell's cathode voltage resistance.

When the anode effect prediction time period $S_T$ increases (1 hour, or longer) due to an alumina overfeed situation then the average alumina control cycle $K_T$ will increase correspondingly.

A short anode effect prediction time period $S_T$ is indicative of a low alumina level (normally less than 2.5%) in the cell and is undesirable situation as it results in a lower cell production and higher specific energy consumption.

When the anode effect prediction time period $S_T$ decreases (30 minutes, or less) due to an insufficient alumina feed situation, then the average alumina control cycle $K_T$ will decrease correspondingly.

Parameter Selection For Long-Term Alumina Control

The regular feed rate, $R_T$ is set equal to the theoretical requirement for alumina consumption for the reduction cell. The parameters for the two feed rates, ultrarapid feed rate, $U_T$, and rapid feed rate, $P_T$, are based on a percentage of the regular feed rate and the parameter for the predetermined alumina control cycle target time $O_T$ is determined in an empirical manner. Short reduction cell studies are conducted in which bath samples are obtained at equal time intervals (for example, every 15 minutes) for alumina analysis; the cell's resistance is monitored continuously; and the results are compared with the cell's automatic alumina control cycles.

The test is repeated until an optimum alumina level in the bath is maintained by adjusting the feed rate to the cell during the regular feed period of the automatic alumina control cycle. The cell is then operated with the empirically determined parameters for an extended period of time, one to four weeks, to monitor the effects on the cell's performance, muck conditions, and cell operations.

Calculations For The Modulation Of The Regular Feed Rate

The average time interval between control cycles $K_T$ for M number of control cycles is calculated in accordance with the equation:

$$K_T = \frac{(t2 - t1) + (t3 - t2) + \ldots (tx - tx - 1)}{M}$$

Where, (tx−tx−1) is equal to the time period between each alumina control cycle, from the start of ultrarapid feed to the start of the next ultrarapid feed cycle.

Figure 2:
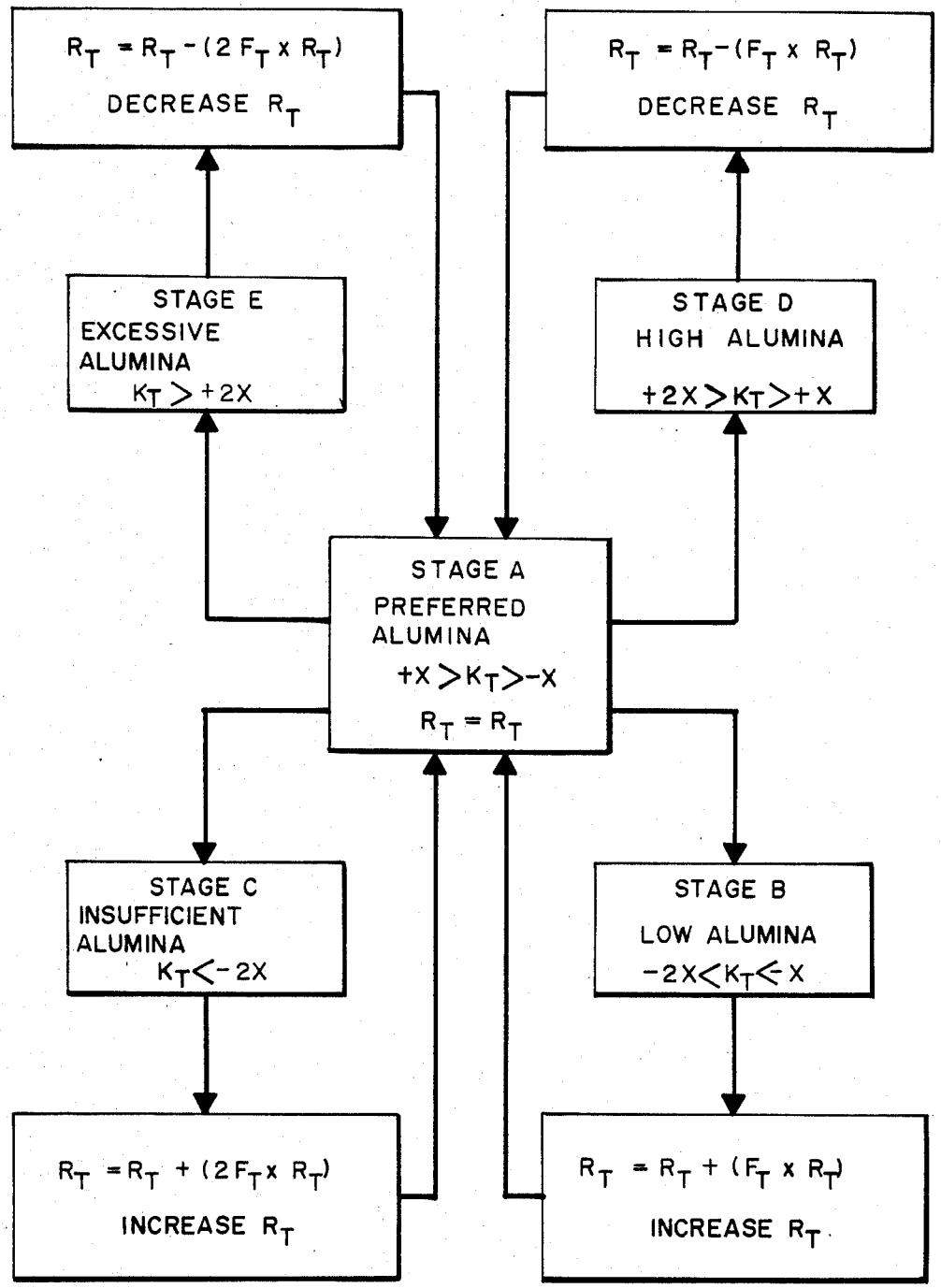
FIG. 2 is a flow chart illustrating the modulation of the regular feed rate according to the present invention.

The modulation of the regular feed rate is calculated by comparing the average alumina cycle time period $K_T$ to two different sets of upper and lower limit bands, (+2X, +X, −X and −2X) and determining the necessary change in the regular feed rate $R_T$ as shown in FIG. 2.

A. If the average alumina cycle time period $K_T$ is less than the upper limit, +X, but greater than the lower limit, −X, then the regular feed rate $R_T$ remains constant.

When $+X > K_T > -X$, then $R_T = R_T$.

B. If the average alumina cycle time period $K_T$ is less than the lower limit, −X, but greater than the lower limit, −2X, then the regular feed rate $R_T$ is increased by a factor, $F_T$, which is a percentage of $R_T$.

When, $-2X < K_T < -X$, then $R_T = R_T + (F_T \times R_T)$.

C. If the average alumina cycle time period $K_T$ is less than the lower limit, −2X, then the regular feed rate $R_T$ is increased by a factor, $2F_T$.

When, $K_T < -2X$, then $R_T = R_T + (2F_T \times R_T)$.

D. If the average alumina cycle time period $K_T$ is greater than the upper limit, +X, but less than the upper limit, +2X, then the regular feed rate $R_T$ is decreased by a factor, $F_T$.

When, $+2X > K_T > +X$, then $R_T = R_T - (F_T \times R_T)$.

E. If the average alumina cycle time period $K_T$ is greater than the upper limit, +2X, then the regular feed rate $R_T$ is decreased by a factor, $2F_T$.

When, $K_T > +2X$, then $R_T = R_T - (2F_T \times R_T)$.

Parameter Selection For Feed Modulation

The choice for the best parameters for the two sets of upper and lower limit bands, (−2X, −X, +X, and +2X) is determined in the same empirical manner as that used to determine the regular feed rate. The upper and lower limits are utilized to modulate the regular feed rate $R_T$ when the average alumina cycle time indicates that alumina levels in the cell needs corrective action.

EXAMPLE

Typical limit bands for a 70 kA reduction cell with a target cycle of 240 minutes:

| Alumina Control Cycle | Modulated Regular Feed |
|---|---|
| 1. If $K_T$ is −15 to +30 minutes of target | No Change |
| 2. If $K_T$ is +30 to +60 minutes > target, | $R_T$ decreased by 1% |
| 3. If $K_T$ is over +60 minutes > target, | $R_T$ decreased by 2% |
| 4. If $K_T$ is −15 to −30 minutes < target, | $R_T$ increased by 1% |
| 5. If $K_T$ is over −30 minutes < target, | $R_T$ increased by 2% |

| | NORMAL ALUMINA FEED RATES | | AVERAGE TIME CYCLE |
|---|---|---|---|
| | Percent | Pounds/Hour | Minutes |
| Regular Feed, $R_T$ | 100 | 90 | 120 |
| Ultrarapid Feed, $U_T$ | 160 | 144 | 20 |
| Rapid Feed, $P_T$ | 140 | 126 | 50 |
| Suspended Feed, $S_T$ | 0 | 0 | 50 |
| | | | Total 240 = $K_T$ |

Typical Alumina Changes For Each Control Phase

| Phase | Alumina Change |
|---|---|
| Suspended Feed, $S_T$ | 1% decrease during the 50 minute period. |
| Ultrarapid Feed, $U_T$ | 0.8% increase during the 20 minute period. |
| Rapid Feed, $P_T$ | 0.6% increase during the 50 minute period. |
| Regular Feed, $R_T$ | 1% decrease during the 120 minute period. |

Results

The short term alumina control and long term feed modulation algorithms allow the process control computer to regulate the regular feed rate to a reduction cell operating with point feeder devices depending on whether a higher or lower level of alumina concentration is inferred in the cell from the average time interval between alumina control cycles.

The result in the reduction cell is that it is possible to maintain alumina levels within a desired range, normally from about 2.0 to 4.0 weight percent, which is preferred for maximum productivity and minimum specific power consumption. Secondly, the alumina levels are maintained at levels which are conducive for good alumina solubility, reducing the opportunity for formation of alumina muck deposits on the cathode floor. This is an important consequence of the automatic alumina control and feed modulation algorithms. Implementation of these alumina control features eliminates several problems common to the operation of reduction cells:

Occasional interventions in the cells normal operations, e.g., crust breaks, tapping, anode changing, anode movements, etc. result in temporary high uncomplicated increases in the cell's alumina levels. The size of these increases are effectively random and cannot be precisely determined under normal conditions.

Changes in alumina physical properties, e.g., density, alpha content, particle size distributions, etc. can result in higher or lower uncompensated changes in the cell's alumina levels.

Cell operation at lower than normal temperature practices, e.g., accidental consequences of reduced power operation, changes in alumina crust thermal conductivity properties, etc. normally results in increased muck formation.

Cell operation at lower than normal temperatures due to design changes in the cells' electrolyte chemistry, thermal insulation design, reduced power consumption, etc. can result in increased muck formation.

We claim:

1. A method for controlling the amount of alumina fed to a reduction cell from point feeders so as to avoid overfeeding or underfeeding of the cell comprising the steps of:

(a) experimentally intentionally over-and-under-feeding a control cell of the type of cell to be controlled to determined statisticallly significant values of:
  (i) a rate of change in bath control cell resistance with respect to time and alumina concentrations to define a line slope G;
  (ii) a statistical correlation coefficient of the last N number of readings on the resistance of the control cell H;
  (iii) a statistical correlation coefficient of the sum of the slopes of the last N number readings of the resistance of the control cell L;
  (iv) an optimum control cycle time of the control cell $O_T$;
  (v) an inner control band +X, −X and an outer control band +2X, −2X about $O_T$; and
  (vi) a regular feed rate $R_T$ of the cell to be controlled;

(b) determining the rate of change in bath resistance of the cell to be controlled with respect to time and alumina concentration to define a line slope g;

(c) defining a statistical coefficient R of the last N number of readings of the bath resistance of the cell to be controlled;

(d) defining a sum of the slopes S of the last N number of readings of the bath resistance of the cell to be controlled;

(e) altering the feed rate of the cell to be controlled if all of the following conditions are met:
  (i) the slope g is within the experimentally determined rate of G volts/minute at a normalized line amperage;
  (ii) $R^2$ exceeds the experimentally determined limit H; and
  (iii) S exceeds the experimentally determined limit L, in a control cycle as follows:
    A. feeding the cell to be controlled at an ultrarapid feed rate substantially higher than $R_T$ for a first period of time;
    B. feeding the cell to be controlled at a rapid feed rate somewhat higher than $R_T$ for a second period of time;
    C. feeding the cell to be controlled at the regular feed rate $R_T$ for a third period of time; and
    D. suspending feeding of the cell to be controlled until the conditions (i), (ii) and (iii) are met again; and (f) modulating the normal feed rate $R_T$ in the following manner:
  1. determining an average time interval $K_T$ between the last M number of control cycles;
  2. changing the normal feed rate $R_T$ by a percentage $F_T$ of $R_T$;
     if $+X > K_T > -X$ then $R_T = R_T$;
     if $-2X < K_T < -X$ then $R_T = R_T + R_T + (F_T \times R_T)$
     if $K_T < -2X$ then $R_T = R_T + (2F_T \times R_T)$;
     if $+2X > K_T > +X$ then $R_T = R_T - (F_T \times R_T)$;
     if $K_T > +2X$ then $R_T = R_T - R_T - (2F_T \times R_T)$; and
  3. changing the ultrarapid and rapid feed rates by the same amount as $R_T$.

2. The method of claim 1 wherein G is selected such that there is a degree of confidence of at least 80% that an electrode upset will occur if alumina is not fed to the cell to be controlled.

3. The method of claim 2 wherein R is determined by the least square line method and the value H is selected as the correlation coefficient which exists at the point G.

4. The method of claim 1 wherein $O_T$ is about 4 hours.

5. The method of claim 4 wherein +X is about 30 minutes, +2X is about 60 minutes, −X is about −15 minutes and −2X is about −30 minutes.

6. The method of claim 1 wherein $F_T$ is about 1% by weight of $R_T$.

7. The method of claim 1 wherein said ultrarapid feed rate is about 25–60% by weight higher than $R_T$ and said first period of time is about 5–30 minutes.

8. The method of claim 1 wherein said rapid feed rate is about 10–40% by weight higher than $R_T$ and said second period of time is about 10–60 minutes.

9. The method of claim 1 wherein said third period of time is about 30 minutes–3 hours.

10. The method of claim 1 wherein M is 6.

* * * * *